United States Patent [19]

Adair

[11] 4,060,139

[45] Nov. 29, 1977

[54] UNDERWATER GAS DISCHARGE HAMMER WITH GAS RESERVOIR

[75] Inventor: Harold Lee Adair, Rockwall, Tex.

[73] Assignee: Raymond International Inc., Houston, Tex.

[21] Appl. No.: 745,637

[22] Filed: Nov. 29, 1976

[51] Int. Cl.[2] ..... B25D 9/00

[52] U.S. Cl. ..... 173/137; 173/DIG. 1

[58] Field of Search ..... 61/53.5; 91/4, 224; 173/127, 128, 132, 137, DIG. 1

[56] References Cited

U.S. PATENT DOCUMENTS

| | | | |
|---|---|---|---|
| 1,005,770 | 10/1911 | Clark | 173/127 |
| 1,958,041 | 5/1934 | Hansen | 173/162 X |
| 2,110,331 | 3/1938 | Gartin | 91/224 |
| 2,633,832 | 4/1953 | Spurlin | 173/137 X |
| 3,646,598 | 2/1972 | Chelminski | 61/53.5 |
| 3,714,789 | 2/1973 | Chelminski | 61/53.5 |
| 3,721,095 | 3/1973 | Chelminski | 61/53.5 |
| 3,817,335 | 6/1974 | Chelminski | 173/127 |
| 3,881,557 | 5/1975 | Gendron et al. | 173/DIG. 1 |
| 3,935,908 | 2/1976 | Pepe | 173/127 |
| 3,958,647 | 5/1976 | Chelminski | 173/127 |

FOREIGN PATENT DOCUMENTS

| | | | |
|---|---|---|---|
| 730,769 | 1/1943 | Germany | 173/128 |
| 424,948 | 9/1974 | U.S.S.R. | 61/53.5 |

*Primary Examiner*—Lawrence J. Staab

*Attorney, Agent, or Firm*—Fitzpatrick, Cella, Harper & Scinto

[57] ABSTRACT

An underwater gas discharge type hammer is provided with a gas reservoir into which expended ram driving gas exhausts to avoid aeration of incoming water which surrounds the gas discharge device of the hammer. The gas resevoir is also arranged as a diving bell to minimize pressure changes under the hammer ram and thereby to maximize ram stroke and improve sharpness of ram impact on the hammer anvil.

13 Claims, 4 Drawing Figures

UNDERWATER GAS DISCHARGE HAMMER WITH GAS RESERVOIR

BACKGROUND OF THE INVENTION

1. Field of the Invention

This invention relates to gas discharge type underwater hammers and more particularly it concerns novel underwater hammer constructions having improved driving characteristics.

2. Description of the Prior Art

Prior art gas discharge type underwater hammers are shown and described in U.S. Pat. No. 3,958,647 to Stephen V. Chelminski. Other patents in this field are U.S. Pat. Nos. 3,604,519; 3,646,598; 3,714,789; 3,721,095; 3,788,402; 3,817,335 and 3,892,279. In general, a gas discharge type underwater hammer comprises an elongated guide tube, a massive ram that is driven up and down in the tube, an anvil in the tube which is hammered upon by the ram and a gas discharge device positioned between the ram and the anvil. When the gas discharge device is triggered, it releases a charge of highly compressed gas which drives the ram upwardly in the guide tube. When the pressure of the gas dissipates and the ram loses its upward momentum it falls back onto the anvil; and the striking force of the ram on the anvil drives the pile, or other element on which the anvil is mounted, downwardly. The gas which is used to drive the ram upwardly in the guide tube is exhausted from the hammer during each cycle through an annular clearance between the ram and the guide tube; and the region under the ram is reflooded prior to the next gas discharge by a flow of water shown through a central passageway in the ram.

SUMMARY OF THE INVENTION

The present invention involves the provision of a gas reservoir in a novel manner to improve the driving characteristics of gas discharge type underwater hammers.

According to one aspect of the invention, the gas reservoir is arranged to be placed into communication with the interior of the ram guide tube under the ram after the ram has been driven upwardly. The space between the ram and guide tube above the region of communication is essentially sealed to prevent passage of the gas which is used to drive the ram upwardly in the guide tube. This gas exhausts into the reservoir and is thereby prevented from aerating the incoming water which refloods the region under the ram. It has been found that if the reflood water is not aerated the transfer of energy from the gas discharge device to the ram is made more effective and the ram will be driven to a greater height for a given gas charge then it would if the gas charge is released into a region flooded with aerated water.

According to a further aspect of the invention the gas reservoir is arranged to be brought into communication with the space under the ram when the ram is driven upwardly in the guide tube. This effectively increases the space in the guide tube so that the percentage volume change, and corresponding pressure change, in that space due to ram movements is minimized. This reduces the suction effects of negative pressure as the ram moves upwardly and thereby allows the ram stroke to be increased. In addition it prevents water from being drawn into the space under the ram and flooding the impact surface of the anvil. If the anvil impact surface is flooded at the time of impact, the hammer blow is cushioned. Further, the gas reservoir serves to minimize the buildup of gas pressure under the ram as it descends; and in this way the cushioning effects of entrapped gas between the hammer and anvil at the time of impact are minimized.

According to a still further aspect of the present invention the gas reservoir takes the form of an inverted vessel, such as a diving bell, which is closed at the top and open at the bottom to surrounding sea water. The gas thus trapped in the reservoir is thereby made subject to the pressure of the surrounding sea water and it can undergo volume changes during operation of the hammer without corresponding pressure changes.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

One embodiment of the invention has been chosen for purposes of illustration and description, and is shown in the accompanying drawing, forming a part of the specification, wherein.

DETAILED DESCRIPTION OF THE PREFERRED EMBODIMENT

Figure 1:
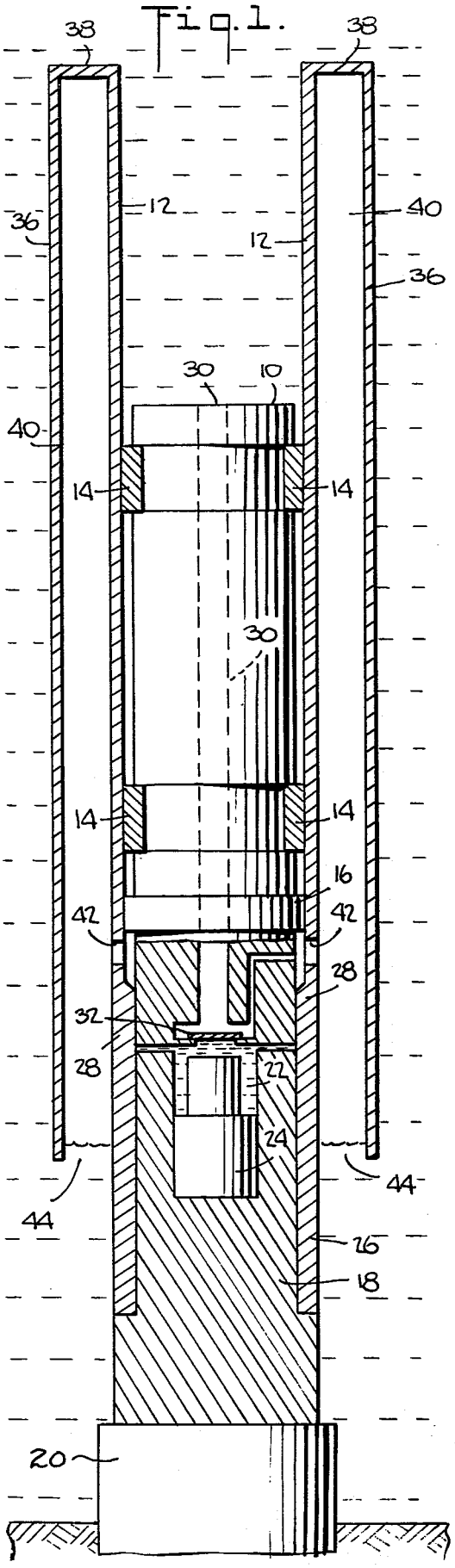
FIG. 1 is an elevational section view, in diagramatic form, of an underwater hammer in which the present invention is embodied.

The underwater hammer of the present invention is particularly suited to the driving of piles into a sea bed, for example, to secure in place an off shore structure such as an oil drilling tower or the like. The hammer is shown in the drawings herein in diagramatic form in order to simplify and clarify its general construction and operation. It will be appreciated by those skilled in the art that the precise dimensional relationships of the actual operative hammer should not be taken from the drawings but instead should be calculated according to the desired operating parameters. As shown in FIG. 1, the hammer comprises a massive ram 10 which is fitted inside a guide tube 12. A plurality of guide shoes 14 are provided about the periphery of the ram 10 and these serve to maintain the ram centered within the guide tube 12 while allowing the ram to move up and down therein. A ram seal 16 is provided around the periphery of the ram 10 to occupy the space between the ram and guide tube and thereby provide a substantial seal to minimize leakage of water.

An anvil 18 is fitted to bottom of the guide tube 12 to be impacted by the ram when it descents. The anvil 18 is fitted to a pile cap 20 which transmits the impact energy of the ram upon the anvil down to a pile (not shown) or other element to be driven.

The anvil 18 is provided with a central cavity 22 which is open at the upper surface of the anvil; and in this cavity there is provided a gas discharge device 24. The details of the gas discharge device form no part of the present invention and therefore they will not be described herein. Suitable such devices are described in detail in U.S. Pat. No. 3,310,128; No. 3,379,273; No. 3,817,335; No. 3,892,279 and No. 3,958,647. The gas discharge device 24 accumulates a charge of gas, such as air, nitrogen, etc. at a very high pressure; and then, upon receipt of a triggering signal, the pressurized gas charge is suddenly released into the surrounding region. Triggering may be effected by means of electrical signals generated at a remote location, e.g. from a vessel or other structure situated above the surface of the water in which the hammer is submerged.

In operation of the hammer as thus far described the hammer is situated under water with the ram 10 resting on the upper surface of the anvil 18. When the gas discharge device 24 is triggered, the sudden release of gas drives the ram 10 up inside the guide tube 12. The ram continues upwardly within the tube until the momentum imparted to it by the expanding gas is dissipated, whereupon the ram falls back inside the tube and impacts against the upper face of the anvil 18 to drive it and the pile cap 20 downwardly. In the meantime a further charge of pressurized gas is built up in the gas discharge device 24; and when this has been completed, the gas discharge device is triggered again to initiate another hammering cycle.

It will be noted that the guide tube 12 has a thickened portion 26 at its lower end. This thickened portion fits closely around the lower end of the ram 10 when it rests upon the anvil 18. The region of the thickened portion 18 into which the lower end of the ram 10 extends is known as the acceleration sleeve 28. In this region the forces produced by the expanding gas from the gas discharge device are nearly entirely directed against the bottom of the ram, so that the ram will be driven to the maximum possible height in the gas tube.

As discussed in the above identified U.S. Pat. No. 3,958,647 the efficiency of the hammer is improved when the cavity 22 containing the gas discharge device is filled with water at the time of triggering. In order to ensure that the cavity will be filled with water, a central reflooding passageway 30 is provided to extend axially through the ram 10 between its upper and lower ends. When the ram is at rest on the anvil 18, water can pass down through this passageway to flood the cavity 22 before the gas discharge device is subsequently triggered.

It is necessary to prevent the energy of the expanding gas from the gas discharge device 24 from being expended in merely driving water back out through the reflooding passageway. Accordingly, there is provided a reflooding check valve plate 32 which covers and seals off the lower end of the reflooding passageway 30 in response to the forces produced by the gas discharge device. After the ram comes to rest on the anvil 18, the valve plate 32 falls away from the lower end of the ram 10 to allow water to flow from the reflooding passageway 30 into the central cavity 22. In order to vent the central cavity 22 so that water can flow into it from the reflooding passageway 30 there is provided a reflood vent passage 34 which extends from the bottom of the ram up to a location on the ram surface up above the acceleration sleeve 28.

As shown in FIG. 1, there is provided an outer casing 36 which surrounds the guide tube 12. An annular top plate 38 extends between the guide tube and the outer casing to form as annular gas reservoir 40 therebetween. Reservoir communication ports 42 extend through the guide tube 12 just above the acceleration sleeve 28; and these ports establish communication between the gas reservoir 40 and the interior of the guide tube 12 under the ram 10 when the ram rises in the guide tube up beyond the acceleration sleeve. The lower end of the gas reservoir 40 has an opening 44 to the surrounding sea water. The opening 44, it will be noted, is a finite distance below the reservoir communication ports 42 and this distance is chosen so that the pressure of air entrapped in the gas reservoir 40 will prevent water from rising in the lower opening 44 up to the level of the reservoir communication ports 42. In this sense the reservoir operates in the manner of a diving bell.

In order to maintain structural rigidity of the hammer, stiffening ribs (not shown) may be mounted to extend radially from the guide tube 12 to the outer casing 36. Also, it may be preferred, from a structural standpoint, to close the lower end of the outer casing 36 and to provide openings in its side near its lower end to serve as the lower openings 44.

Operation of the hammer with the above described gas reservoir 40 will now be described in conjunction with FIGS. 1–4. As shown in FIG. 1 the hammer is submerged with the anvil 18 resting upon the pile cap 20 near the sea bed. The ram 10 rests upon the anvil 18 with the lower end of the ram projecting into the acceleration sleeve 28. The central cavity 22 is flooded with sea water which enters via the reflooding passageway 30 and past the reflood valve plate 32. All air which may have been present in the cavity 22 is vented through the reflood vent 34 and the reservoir communication ports 42 into the gas reservoir 40.

During operation of the hammer the gas reservoir 40 is filled with gas at a pressure equal to that of the head of water above the water level near the bottom of the reservoir. It may be that initially the gas reservoir 40 will be partially or totally filled with sea water. However, after a few cycles of operation of the hammer the reservoir will become purged of seawater and thereafter normal operation will ensue.

Because the pressure head in the gas reservoir is greater than the pressure in the reflood vent 34, water will not continue to flow through the vent after the central cavity 22 has been flooded.

Figure 2:
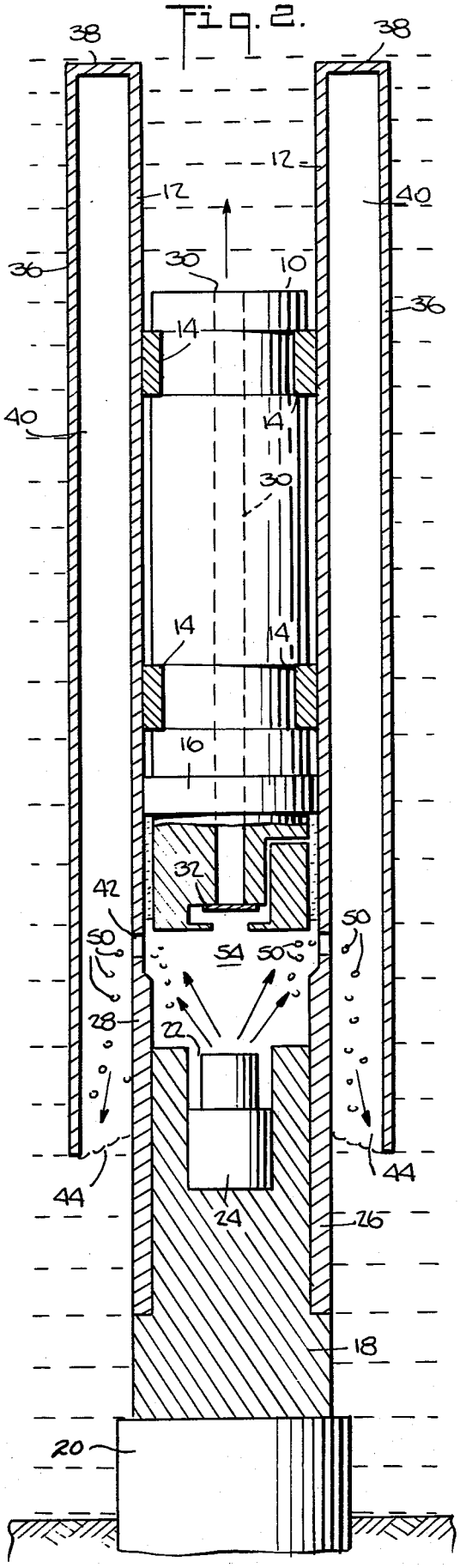
FIGS. 2–4 are views similar to FIG. 1 but showing the various components of the hammer at positions corresponding to different stages of an operating cycle of the hammer.
Figure 3:
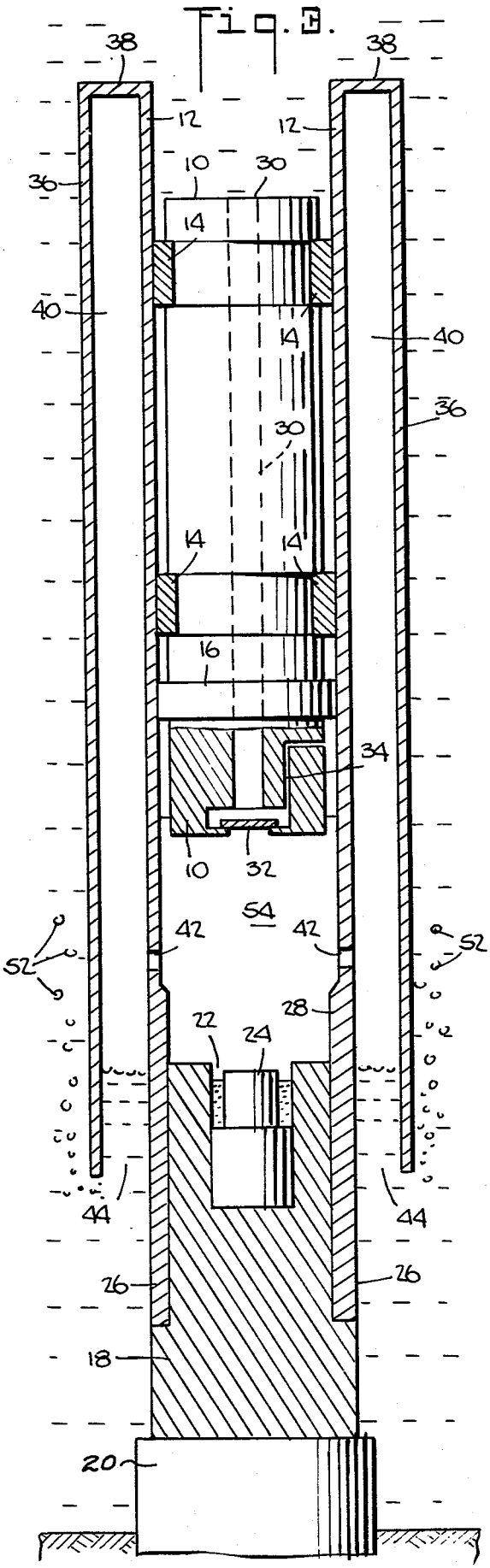

When the gas discharge device 24 has received a charge of high pressure gas, it is triggered and suddenly releases this charge of gas into the cavity 22 under the ram 10. This pressurized gas begins to expand rapidly and it drives the ram 10 upwardly out of the acceleration sleeve 28 as shown in FIG. 2. It will be noted that the sudden release of high pressure gas under the reflood valve plate 32 forces the plate up against the bottom of the reflooding passageway 30 to seal if off so that nearly the entire force generated by the exapnding gas will be directed against the ram 10 to drive it upwardly. By the time that the bottom of the ram 10 has passed above the reservoir communication ports 44, the major portion of the energy of the expanding gas charge will have been transferred to the ram in the form of kinetic energy; and the ram thereafter continues upwardly in the guide tube 12 by its own momentum. The still expanding gases under the ram force the water that had been in the cavity 22 out through the reservoir communication ports as indicated by droplets 50 in FIG. 2. Since this expanding gas is at a higher pressure than the pressure in the reservoir 40 it will cause a lowering of the water level in the reservoir.

As the ram 10 continues to move upwardly in the guide tube 12 by its own momentum the space under the ram, indicated by the numeral 54, increases correspondingly. In prior art gas discharge type hammers, the pressure in this space would drop very rapidly as the ram moved upwardly and it would have a decelerating effect which would limit the ram stroke. Also, when the pressure under the ram dropped it would cause the reflood valve plate 32 to open and water would prematurely pass through the reflooding passageway 30 and cushion the anvil 18 before the ram could descend. In the present invention, however, the space 54 under the ram 10 is in communication via the ports 42 with the gas reservoir 40, and therefore the percentage volume increase caused by the upward movement of the ram is lessened. Further, the pressure in the gas reservoir 40 as well as in the space 54 is controlled by the head of water acting through the lower opening 44 on the gas reservoir. Thus the pressure under the ram decreases only minimally while the volume displacement of the ram is accommodated by up and down movement of the water level inside the bottom opening 44 of the gas reservoir.

After the ram 10 has expended its upward momentum it begins to descend in the guide tube 12. As the ram descends it tends to compress the gas underneath it. In prior art hammers this produced a cushioning effect which interfered with a sharp impart by the ram on the anvil. With the present invention, however, the gas under the ram is forced out through the reservoir communication ports 42 into the reservoir 40 and from there it passes out through the bottom opening 44 and escapes from the gas reservoir in the form of bubbles 52.

Figure 4:
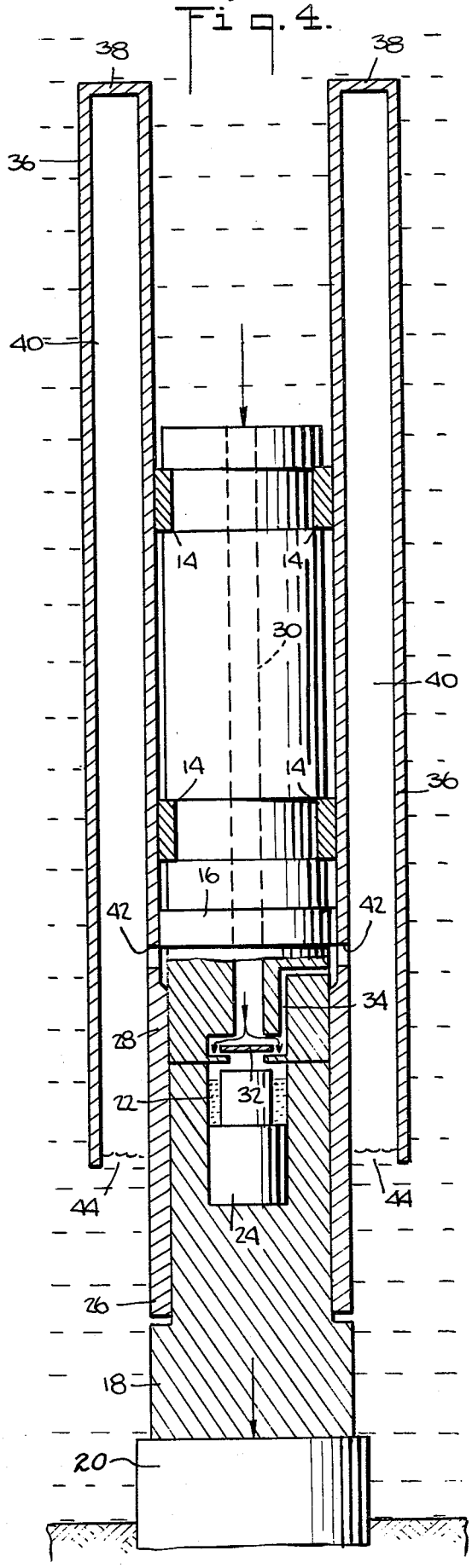

Eventually, the lower end of the ram 10 enters the acceleration tube 28 and then impacts against the anvil 18, as shown in FIG. 4, to drive the anvil, the pile cap 20 and the pile or other structure on which the pile cap 20 rests, downwardly into the sea bed. At the moment of impact there is no water on the impact surface of the anvil. Further, since the gas under the ram does not begin to undergo compression until the ram enters the acceleration tube 28, both the water and the gas cushioning effects experienced in the prior art are minimized and a very sharp blow is delivered to the anvil.

After the ram has come to rest, as shown in FIG. 4, the reflood valve 32 experiences a pressure balance which allows it to drop so that the central cavity 22 can be reflooded prior to a subsequent stroke.

It will be appreciated from the foregoing that the gases which drive the ram upwardly exit from the guide tube 12 through the reservoir communication ports 42 and into the gas reservoir 40. After the ram has begun to descend in the guide tube 12, its downward movement serves to force gases out from the guide tube 12 and into the gas reservoir 40. Excess gas escapes from the reservoir 40 through the lower opening 44 and rises, in the form of bubbles 52, around the outside of the hammer. In prior art hammers, on the other hand, the exhausted gases exited from the hammer through the space between the ram and the guide tube. As a result the water at the upper end of the reflooding passageway 30 became highly aerated at the time of reflooding and the central cavity became flooded with aerated water. This aerted water produced a cushioning effect which prevented efficient transfer of gas discharge energy to the ram and consequently limited the height to which the ram could be driven for a given gas charge. With the present invention, however, the exhaust from each preceeding gas charge does not pass up between the hammer and the ram. Instead, it is directed into the gas reservoir. As a result the water which flows down through the reflooding passageway 30 is non-aerated and the following gas discharge can be directed against the ram with maximum effectiveness.

It will further be appreciated that the provision of a gas reservoir according to the present invention serves both to minimize negative pressure under the ram during its upstroke and to minimize positive pressure under the ram during its downstroke. Accordingly, the total ram stroke is increased and the air and water cushioning effects of prior art gas discharge type underwater hammers are minimized.

Although a particular embodiment of the invention is herein disclosed for purposes of expalanation, various modifications thereof, after study of this specification, will be apparent to those skilled in the art to which the invention pertains.

What is claimed and desired to be secured by letters patent is:

1. A gas discharge type underwater hammer comprising, a hollow elongated guide tube open at its upper end, a massive ram guided for up and down movement inside said guide tube, an anvil mounted at the lower end of the guide tube in the path of movement of said ram to be struck by said ram on its downward stroke, means forming a cavity within said guide tube under and open to said ram, a gas discharge device positioned within said cavity, said gas discharge device being operable in response to a triggering signal to emit a sudden discharge of pressurized gas to drive the ram upwardly in the guide tube, a gas reservoir located outside said guide tube, and means for placing the interior of said guide tube under the ram into open fluid communication with said gas reservoir during the upward stroke of said ram.

2. A gas discharge type underwater hammer according to claim 1 wherein said hammer includes means forming a reflooding passageway extending from said cavity to a location outside said hammer, said reflooding passageway being provided with valve means which opens said passageway while said ram is at rest on said anvil.

3. A gas discharge type underwater hammer according to claim 1 wherein said gas reservoir opens into the interior of said guide tube via a reservoir communication opening in the side of said guide tube, said opening being located above the level of the bottom of the ran at rest on said anvil.

4. A gas discharge type underwater hammer according to claim 1 wherein said ram is provided with a circumferential seal extending across the space between the periphery of the ram and the interior of said guide tube.

5. A gas discharge type underwater hammer according to claim 4 wherein said ram is provided with a reflooding passageway extending down through the length of said ram to said cavity.

6. A gas discharge type underwater hammer according to claim 3 wherein said ram is provided with a circumferential seal extending across the space between the periphery of the ram and the interior of said guide tube, said seal being located above said reservoir communication opening with the ram at rest on said anvil.

7. A gas discharge type underwater hammer according to claim 1 wherein the interior of said gas reservoir is exposed to ambient water pressure.

8. A gas discharge type underwater hammer according to claim 1 wherein said gas reservoir comprises an elongated submerged chamber having a reservoir communication opening leading into the interior of said guide tube above the level of the ram at rest on said anvil, and said reservoir having a lower opening to the surrounding sea and located below said reservoir communiation openings, said reservoir being closed above said openings.

9. A gas discharge type underwater hammer according to claim 1 wherein said gas reservoir comprises an outer casing surrounding said guide tube to define an annular space therebetween and an upper plate extending across the top of said annular space.

10. A gas discharge type underwater hammer according to claim 9 wherein said guide tube is formed with a reservoir communication opening leading into said gas reservoir from a location above the bottom of the ram at rest on said anvil.

11. A gas discharge type underwater hammer according to claim 10 wherein said gas reservoir is formed with a lower opening to the surrounding sea said lower opening being located below said reservoir communication opening.

12. A gas discharge type underwater hammer according to claim 11 wherein said ram is formed with a circumferential seal extending across the space between the periphery of said ram and the interior of said guide tube, said seal being located above said reservoir communication opening with the ram at rest on said anvil.

13. A gas discharge type underwater hammer according to claim 12 wherein said ram is formed with a reflooding passageway extending from its upper end down to said cavity and a valve plate operative to cover and seal said passageway in response to pressure produced by said gas discharge device.

* * * * *